United States Patent [19]

Grim

[11] Patent Number: 4,758,841

[45] Date of Patent: Jul. 19, 1988

[54] POLARIZED SIGNAL RECEIVER PROBE

[76] Inventor: Fay Grim, 565 Newburgh, Port Charlotte, Fla. 33952

[21] Appl. No.: 844,070

[22] Filed: Mar. 26, 1986

Related U.S. Application Data

[63] Continuation-in-part of Ser. No. 820,721, Jan. 21, 1986, Pat. No. 4,672,388, which is a continuation-in-part of Ser. No. 796,284, Nov. 8, 1985, which is a continuation-in-part of Ser. No. 621,119, Jun. 15, 1984, Pat. No. 4,554,553.

[51] Int. Cl.[4] ..... H01P 1/165

[52] U.S. Cl. ..... 343/786; 333/21 A

[58] Field of Search ..... 333/21 A, 21 R; 343/786, 781 R

[56] References Cited

U.S. PATENT DOCUMENTS

| | | | |
|---|---|---|---|
| 2,548,821 | 4/1951 | Riblet et al. | 343/786 X |
| 2,742,612 | 4/1956 | Cohn | 333/21 R |
| 3,681,714 | 8/1972 | Terakawa | 333/21 R |
| 4,414,516 | 11/1983 | Howard | 333/21 A |
| 4,528,528 | 7/1985 | Augustin | 333/21 A |
| 4,574,258 | 3/1986 | Cloutier | 333/21 A |

FOREIGN PATENT DOCUMENTS

| | | | |
|---|---|---|---|
| 804200 | 11/1958 | United Kingdom | 333/21 A |

*Primary Examiner*—Eugene R. Laroche
*Assistant Examiner*—Benny T. Lee
*Attorney, Agent, or Firm*—Gifford, Groh, VanOphem, Sheridan, Sprinkler & Dolgorukov

[57] ABSTRACT

A polarized signal receiver waveguide assembly, or feedhorn, for receiving a selected one of linearly polarized electromagnetic signals in one waveguide of circular cross-section and for launching or transmitting the selected signal into a second waveguide, the axes of the waveguides being disposed at right angle. The first waveguide has a closed end wall, either flat or, alternatively, formed as a hemispherical cavity having a hemispherical concave surface. A probe comprising a signal receiver portion disposed in a plane perpendicular to the axis of the first waveguide and a launch or transmitter portion having its axis perpendicular to the axis of the second waveguide has its launch or transmitter portion mounted in a controllably rotatable dielectric rod, such that rotation of the rod causes rotation of the signal receiver portion for alignment with a selected one of the polarized signals. The transmission line between the probe signal receiver portion and launch or transmitter portion consists of a single conductor in the form of a solid disk-shaped member extending at an angle to the axis of symmetry of the first waveguide.

24 Claims, 2 Drawing Sheets

POLARIZED SIGNAL RECEIVER PROBE

CROSS REFERENCE TO RELATED APPLICATIONS

The present application is a continuation-in-part of application Ser. No. 820,721, filed Jan. 21, 1986 for Polarized Signal Receiver Waveguides and Probe, now U.S. Pat. No. 4,672,388, issued June 9, 1987, which is in turn a continuation-in-part of currently pending application Ser. No. 796,284, filed Nov. 8, 1985 for Polarized Signal Receiver Waveguides and Probe, which is a continuation-in-part of application Ser. No. 621,119, filed June 15, 1984 for Polarized Signal Receiver Probe, now U.S. Pat. No. 4,554,553, issued Nov. 19, 1984.

BACKGROUND OF THE INVENTION

The present invention relates to polarized signal receiver waveguides in general, or so-called "feedhorns", as used in dish antennas for TVRO (television receive only) systems, and more particularly to a novel receiver probe for signal receiving and signal transmitting waveguide.

The RF signals transmitted by communication satellite transponders consist of two linearly polarized signals, rotated 90° from each other. The linearly polarized signals reflected by the dish are received through the open end of a feedhorn, installed at the focus of the dish and comprising a cylindrical waveguide of circular cross-section. Only one of the two polarized signals is received, the other signal being reflected out of the feedhorn. The detected signal is fed through a second waveguide, generally a waveguide having a rectangular cross-section, whose axis is conventionally disposed at 90° to the axis of the feedhorn waveguide, and which feeds the detected signal to a low-noise amplifier (LNA).

Various antenna probe arrangements may be used for receiving one of the polarized signals in the feedhorn circular waveguide and for launching, or retransmitting, the detected signal into the rectangular waveguide. Generally, the antenna probe comprises a receiver portion disposed in the circular waveguide, and a signal launch or transmitter portion disposed in the rectangular waveguide, the probe being supported by a rotatable dielectric rod driven by a servomotor mounted on the waveguide assembly. The launch or transmitter portion of the probe has its axis aligned with the axis of the circular waveguide and with the axis of the dielectric rod, such as to remain constantly perpendicular to the axis of the rectangular waveguide during rotation of the probe. The probe receiver portion has its longitudinal axis perpendicular to the axis of rotation such as to rotate between the two orthogonally polarized signals in the circular waveguide. By rotation to a desired position, one polarized signal is received and the other is reflected. The received signal is conducted by the transmission line portion of the probe through the rear wall of the circular waveguide and is launched or retransmitted into the rectangular waveguide by the probe launch or transmitter portion.

As the waveguide assembly is installed in an outdoor TVRO dish antenna, the assembly is exposed to inclement weather, such as rain or snow, dust and high wind, and to atmospheric pollution, all adverse conditions that may cause rapid deterioration, corrosion of the metallic surfaces and loosening of the joint between the waveguides. There results further deterioration of the relatively low level ultra-high frequency signals captured by the antenna system.

The invention disclosed in co-pending application Ser. No. 796,284 is an improvement upon the prior art polarized signal feedhorn waveguides and probes which provides a microwave polarized signal receiver and transmission system in the form of a single-piece waveguide structure having a rotatable probe for receiving an appropriate one of two linearly polarized signals, fed into a first waveguide, and for transmitting the selected one of the signals to a second waveguide disposed perpendicularly to and cast integral with the first waveguide, and for launching or retransmitting the selected signal in the second waveguide.

The invention disclosed in U.S. Pat. No. 4,672,388 also provides a single-piece waveguide assembly, but having a hemispherical concave rear end wall for the circularly cylindrical waveguide, and a rotatable probe provided with a transmission line between the receiver portion of the probe and the launching or re-transmitting portion of the probe which is contoured to the hemispherical shape of the wall.

SUMMARY OF THE INVENTION

The present invention provides a novel receiver probe structure presenting a substantial improvement in the amplitude of the signal transferred from one waveguide to the other, a reduction of parasitical capacitance during transfer of signals from one waveguide to the other, and an increase in the signal-to-noise ratio and in the rejection of unwanted signals, as compared to polarized signal receiver, transmission and launch probes heretofore available.

A better understanding of the present invention and of its many objects and advantages will be obtained by those skilled in the art from the following description of the best mode contemplated for practicing the invention, when read in conjunction with the accompanying drawing wherein:

DETAILED DESCRIPTION OF THE PREFERRED EMBODIMENT

Figure 1:
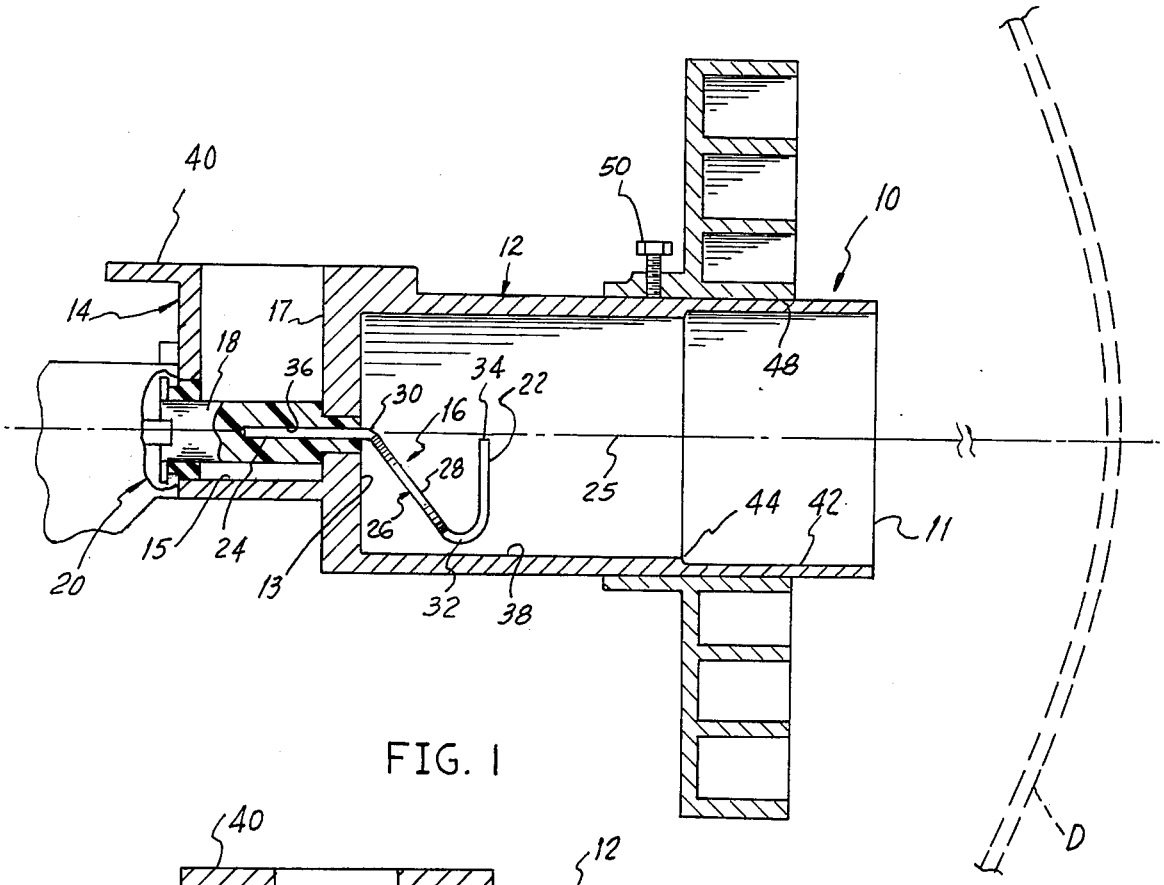
FIG. 1 is a longitudinal sectional view of a waveguide and receiver probe assembly according to the invention.
Figure 2:
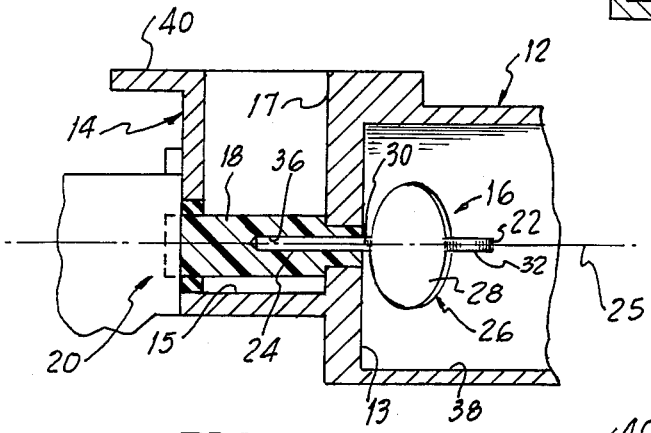
FIG. 2 is a partial view similar to FIG. 1 but showing the receiver probe rotated 90° from the position shown at FIG. 1.

Referring now to the drawing, and more particularly to FIGS. 1–2, there is illustrated a feedhorn 10 for reception of satellite transmitted television signals or other RF signals of ultra-high frequency, for example in the 3.7 to 4.2 GHz range, as presently used. The feedhorn 10 is generally used installed at the focus of a parabolic reflector dish, shown schematically at D at FIG. 1 such that the RF microwaves are reflected into the open end 11 of the feedhorn 10.

The feedhorn 10 is made principally of a pair of waveguides 12 and 14 which, in the example of structure illustrated are cast integrally of metal or metal alloy such as, for example, aluminum alloy. The waveguide 12 is a circularly cylindrical waveguide, i.e. circular in cross-section, while the waveguide 14 is a rectangular waveguide, i.e. rectangular in cross-section.

The circularly cylindrical waveguide 12 has an integral rear wall 13 and is disposed with its longitudinal axis at right angle to the longitudinal axis of the rectangular waveguide 14 formed integrally at the closed end, or rear wall, 13 of the circularly cylindrical waveguide 12. The rectangular waveguide 14 is closed at one end by an end or rear wall 15 and is coupled at its open end to a low-noise signal amplifier (LNA), not shown. A probe 16 is fixedly mounted coaxially in a dielectric rod or shaft 18 disposed rotatable through the rear wall 13 of the circular waveguide which is integral with a corresponding sidewall 17 of the rectangular waveguide 14. The dielectric rod or shaft 18 and the probe 16 are driven in rotation by a servomotor 20.

Figure 3:
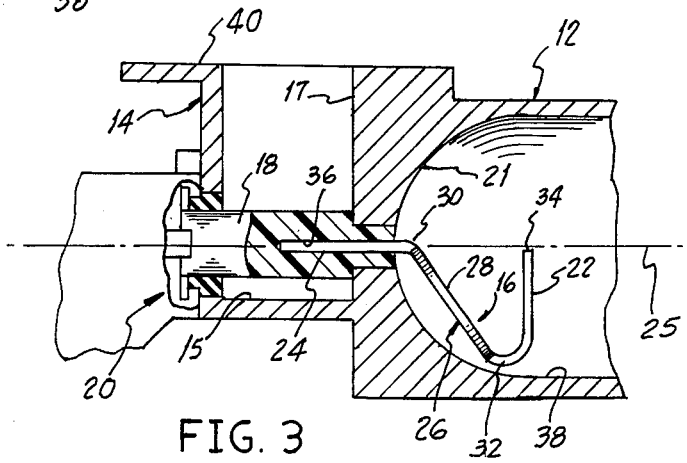
FIG. 3 is a partial view similar to FIG. 1, but showing the receiver probe of the invention in use in conjunction with a modified waveguide.
Figure 4:
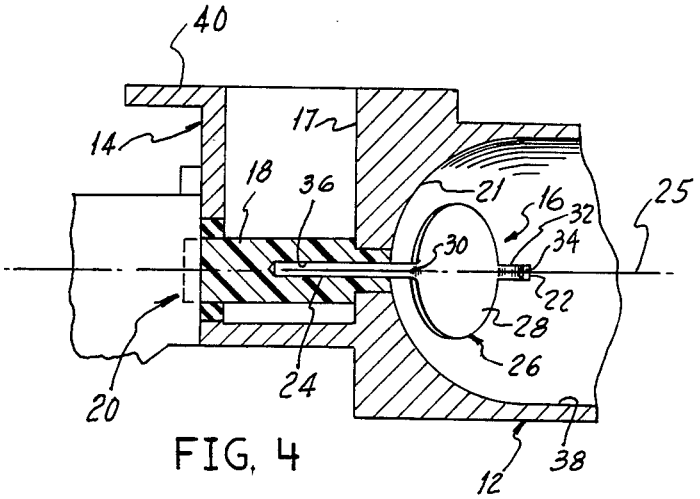
FIG. 4 is a view similar to FIG. 3, but showing the receiver probe rotated 90° from the position shown at FIG. 3.

In the embodiment of FIGS. 3–4, the circularly cylindrical waveguide 12, instead of having a flat rear wall 13, FIGS. 1–2, has a hemispherical concave rear wall 21. The probe 16 is of the same general design as the probe 16 of the structure of FIGS. 1–2, as the structure of the probe 16, described hereinafter in further detail, has been found, experimentally, to be more effective than probes hitherto known in the art, irrespective of the shape of the rear or end wall of the circularly cylindrical waveguide 12.

The probe 16 is made of a single-pice precision casting or stamping of electrically conductive metal or metallic alloy. The probe 16 comprises a receiver portion 22, approximately one-quarter wavelength long, having its longitudinal axis disposed in a plane perpendicular to the longitudinal axis 25 of the circularly cylindrical waveguide 12, and a signal launch, or transmitter portion 24 held within the dielectric rod 18 with its longitudinal axis aligned with the longitudinal axis, or axis of symmetry, 25 of the circularly cylindrical waveguide 12. The probe signal launch or transmitter portion 24 projects within the rectangular waveguide 14, perpendicularly to the longitudinal axis of the waveguide 14. The probe signal receiver portion 22 and signal launch or transmitter portion 24 are integrally connected by a transmission line portion 26 in the shape of a flat disk-shaped member 28.

Figure 7:
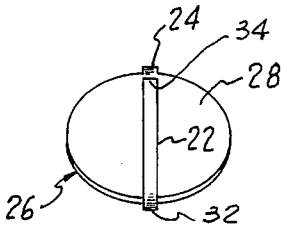
FIG. 7 is a front elevation view thereof.
Figure 5:
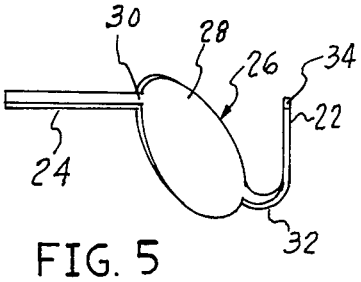
FIG. 5 is a perspective view, from the front, of the receiver probe of the invention.
Figure 6:
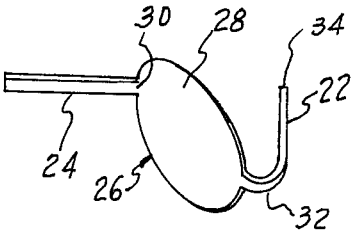
FIG. 6 is a perspective view of the probe from the rear.

As best shown in FIGS. 5–7, the flat disk-shaped member 28 is disposed at an angle of less than 90°, preferably about 40° to 60°, to the longitudinal axis 25 of the circularly cylindrical waveguide 12 and is integrally connected to the launch or transmitter portion 24 via a bent end portion 30 of the launch or transmitter portion 24 of the probe 16. The signal receiver portion 22 is integrally connected to the disk-shaped member 28 at a point of its perimeter diametrically opposed to the point of junction, via the bent end portion 30, to the launch or transmitter portion 24, by way of an integral bent over elbow portion 32. The signal receiver portion 22 of the probe 16 is disposed substantially at a right angle to the axis 25 of symmetry of the circularly waveguide 12, with its tip 34 substantially at, or proximate to, the axis 25 of symmetry. The launch or transmitter portion 24 of the probe is disposed and held, such as by bonding, in a longitudinal bore 36 in the dielectric rod 18, such that when the dielectric rod 18 is rotated by the servo motor 20, the receiver portion 22 of the probe 16 rotates in a plane substantially perpendicular to the axis 25 of the circularly cylindrical waveguide 12, and the disk-shaped member 28, defining the transmission line 26 between the receiver portion 22 and the launch or transmitter portion 24 of the probe 16 rotates as a plane tangent to an imaginary conical surface whose apex intersects the axis 25 of symmetry of the circularly cylindrical waveguide 12.

Figure 8:
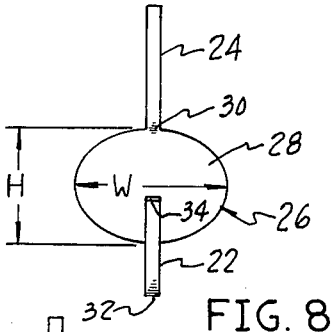
FIG. 8 is a view of an example of structure for the probe of the invention shown with a portion disposed in the plane of the drawing.
Figure 9:
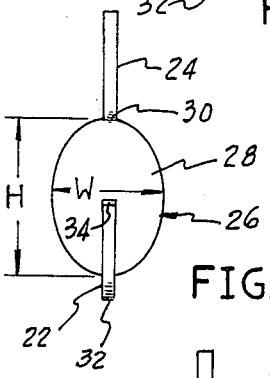
FIGS. 9 and 10 are views similar to FIG. 8 but showing modifications thereof.
Figure 10:
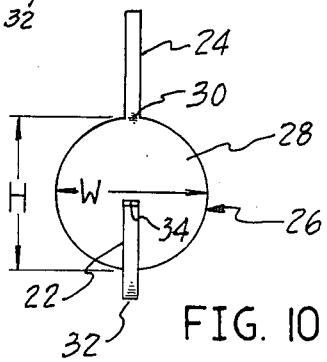

Referring more particularly to FIGS. 8–10, it has been determined experimentally that the disk-shaped member 28 may take any convenient elliptical shape in a wide variety of minor diameter to major diameter ratios. As shown at FIG. 8, the disk-shaped member 28, forming the transmission line 26 between the receiver portion 22 of the probe 16 and the transmitter or launch portion 24 of the probe, is arbitrarily represented as having a major diameter W and a minor diameter H, while the disk-shaped member 28 of FIG. 9 has been arbitrarily represented as having a minor diameter W and a major diameter H. The probe 16 can be made with a W/H ratio which can be arbitrarily selected as most convenient, including a ratio of 1 for the disk-shaped member 28 being a circular member, FIG. 10, such that the disk-shaped member 28 forming the transmission line 26 between the receiver portion 22 and the launch or transmitter portion 24 of the probe 16 may have a selected impedance for appropriate impedance match. As is known, the diameter W, or width, of the disk-like member 28 is an inverse function of the impedance of the transmission line 26 defined by the disk-shaped member 28. It has been found that ratios in the range of 2 to 0.5 seem to be most effective in providing high signal strength and high signal-to-noise ratios.

Dimensionally, only as an example of appropriate dimensions for effective operation in the frequency range of 3.7 to 4.2 GHz, and with a circularly cylindrical waveguide 12 of about 600 mm diameter, the receiver portion 22 of the probe 16 is approximately $\frac{1}{4}$ wavelength in lenth, including the elbow bent portion 32 and is disposed about 520 mm from the flat rear wall 13, FIGS. 1–2, or from a plane tangent to the hemispherical wall 21, FIGS. 3–4, and perpendicular to the axis 25 of the circularly cylindrical waveguide 12. A good impedance match and high strength of signal transmission from the receiver portion 22 of the probe 16 to the transmitter or launch portion 24 have been achieved with the width W of the disk-shaped member 28 defining the transmission line 26 of 32 mm, for a height H of the order of 25 mm., in conjunction with a circularly cylindrical waveguide 12 having a flat rear wall 13, and with a width W of the order of 28 mm. and a height H of the order of 25 mm., for use in conjunction with a circularly cylindrical waveguide 12 having a hemispherical rear wall 21, FIGS. 3–4. For use in the Ku band, such dimensions are one third of the examples of dimensions, hereinabove given for illustrative purpose only.

It is to be noted that the disk-shaped member 28 has no portion parallel to the internal wall 38 of the circularly cylindrical waveguide 12, FIGS. 1–4, or to the flat rear wall 13, FIGS. 1–2, or hemispherical rear wall 32 of the circularly cylindrical waveguide 12, FIGS. 3–4. Typically, in the structure of FIGS. 3–4, the disk-shaped member 28, or transmission line 26, is in a chordal plane of the 90° arc plane projection of one half of the hemispherical wall surface 21.

In operation, the probe 16, FIGS. 1–4, is rotatively driven, from a remote control location, by way of the servomotor 20 rotating the dielectric rod or shaft 18, thus causing the probe signal receiver portion 22 to sweep a substantially circular plane in the circularly cylindrical waveguide 12, perpendicular to the axis 25 of symmetry of the waveguide. As the probe signal receiver portion 22 aligns itself with the desired linearly polarized signal in the circularly cylindrical waveguide 12, the detected signal is transmitted through the disk-like member 28 forming the transmission line 26 to the probe signal launch or transmitter portion 24 projecting in the rectangular waveguide 14. The desired orientation of the probe signal receiver portion 22 is determined by a peak in the detected signal. The signal launched in the rectangular waveguide 14 by the probe signal launch or transmitter portion 24 is evidently unaffected by the rotation of the probe 16, because the probe signal launch or transmitter portion 24 rotates around the axis of symmetry 28 of the circularly cylindrical waveguide 12.

The rectangular waveguide 14 is provided at its open end with a flange 40 for coupling to an approprate input waveguide of the LNA. The circularly cylindrical waveguide 12 is provided at its open end 11 with an internally enlarged diameter portion 42, FIG. 1, forming a shoulder 44 at the junction between the internal cylindrical surface 38 of the circularly cylindrical waveguide 12 and the internal surface of its enlarged diameter portion 42. The step or shoulder 44 acts as a reference shoulder for an appropriate depth gauge, not shown, for exact location, during assembly, of the probe 16 into the dielectric rod 18 for determining the longitudinal positioning of the probe receiver portion 22 in the circular waveguide 12. As previously mentioned, the probe 16 is attached to the dielectric rod or shaft 18 as a result of the probe launch or transmitter portion 24 being cemented in the axially disposed central bore 36, in the dielectric rod 18.

The feedhorn 10 is provided with an adjustable "scaler" ring 48, FIG. 1, which may be longitudinally positioned where most effective along the circular waveguide 12 and held in position by tightening the setscrews or bolts 50.

Having thus described the present invention by way of examples of structures well designed for accomplishing the objects of the invention, modifications whereof will be apparent to those skilled in the art, what is claimed as new is as follows:

1. A polarized signal receiver comprising a first waveguide of circular cross-section for receiving polarized signals, said first waveguide having an opening at one end, a rear wall at an other end and a first axis of symmetry extending therebetween, a second waveguide for transmitting polarized signals having a second axis of symmetry, a dielectric rod controllably rotatably mounted through said rear wall of said first waveguide and having an axis of rotation concentric with said first longitudinal axis, means for controllably rotating said dielectric rod and a signal transferring probe mounted in said dielectric rod concentrically with said axis of rotation thereof, said signal transferring probe comprising a receiver portion disposed in said first waveguide in a plane orthogonal to said first axis of symmetry of said first waveguide for receiving one of the polarized signals in said first waveguide, a launch or transmitter portion extending into said second waveguide substantially perpendicular to said second axis of symmetry of said second waveguide, said launch or transmitter portion being disposed concentrically with said dielectric rod and rotatable in unison with said dielectric rod, and a transmission line portion connecting said receiver portion to said launch or transmitter portion, said transmission line portion comprising a flat disk-shaped member having a perimeter integrally attached at a first point to said launch or transmitter portion and integrally attached to said receiver portion at a second point, said second point substantially diametrically opposed to said first point, said disk-shaped member being disposed in said first waveguide at an angle of less than 90° relative to said first axis of symmetry of said first waveguide.

2. The polarized signal receiver of claim 1 wherein said disk-shaped member has a perimeter height and a perimeter width, said perimeter height extending along a third axis, said third axis extending through said first and said second points, said perimeter width extending along a fourth axis extending in a direction perpendicular to said third axis of said height, and the ratio of said width to said height is one of a range of numbers larger than one and a range of numbers smaller than one, and wherein said width is an inverse function of the impedance of said transmission line portion.

3. The polarized signal receiver of claim 1 wherein said disk-shaped member is integrally connected to said receiver portion via a curved end portion of said receiver portion.

4. The polarized signal receiver of claim 2 wherein said disk-shaped member is integrally connected to said receiver portion via a curved end portion of said receiver portion.

5. The polarized signal receiver of claim 1 wherein said disk-shaped member is integrally connected to said launch or transmitter portion via a bent end portion of said launch or transmitter portion.

6. The polarized signal receiver of claim 2 wherein said disk-shaped member is integrally connected to said launch or transmitter portion via a bent end portion of said launch or transmitter portion.

7. The polarized signal receiver of claim 3 wherein said disk-shaped member is integrally connected to said launch or transmitter portion via bent end portion of said launch or transmitter portion.

8. The polarized signal receiver of claim 4 wherein said disk-shaped member is integrally connected to said launch or transmitter portion via a bent end portion of said launch or transmitter portion.

9. The polarized signal receiver of claim 1 wherein said rear wall of said first waveguide has a flat surface extending normal to said first axis of symmetry.

10. The polarized signal receiver of claim 2 wherein said rear wall of said first waveguide has a flat surface extending normal to said first axis of symmetry.

11. The polarized signal receiver of claim 3 wherein said rear wall of said first waveguide has a flat surface extending normal to said first axis of symmetry.

12. The polarized signal receiver of claim 4 wherein said rear wall of said first waveguide has a flat surface extending normal to said first axis of symmetry.

13. The polarized signal receiver of claim 5 wherein said rear wall of said first waveguide has a flat surface extending normal to said first axis of symmetry.

14. The polarized signal receiver of claim 6 wherein said rear wall of said first waveguide has a flat surface extending normal to said first axis of symmetry.

15. The polarized signal receiver of claim 7 wherein said rear wall of said first waveguide has a flat surface extending normal to said first axis of symmetry.

16. The polarized signal receiver of claim 8 wherein said rear wall of said first waveguide has a flat surface extending normal to said first axis of symmetry.

17. The polarized signal receiver of claim 1 wherein said rear wall of said first waveguide has a concave hemispherical surface concentrically disposed about said first axis of symmetry.

18. The polarized signal receiver of claim 2 wherein said rear wall of said first waveguide has a concave hemispherical surface concentrically disposed about said first axis of symmetry.

19. The polarized signal receiver of claim 3 wherein said rear wall of said first waveguide has a concave hemispherical surface concentrically disposed about said first axis of symmetry.

20. The polarized signal receiver of claim 4 wherein said rear wall of said first waveguide has a concave hemispherical surface concentrically disposed about said first axis of symmetry.

21. The polarized signal receiver of claim 5 wherein said rear wall of said first waveguide has a concave hemispherical surface concentrically disposed about said first axis of symmetry.

22. The polarized signal receiver of claim 6 wherein said rear wall of said first waveguide has a concave hemispherical surface concentrically disposed about said first axis of symmetry.

23. The polarized signal receiver of claim 7 wherein said rear wall of said first waveguide has a concave hemispherical surface concentrically disposed about said first axis of symmetry.

24. The polarized signal receiver of claim 8 wherein said rear wall of said first waveguide has a concave hemispherical surface concentrically disposed about said first axis of symmetry.

* * * * *